US005454141A

United States Patent [19]

Ozbun et al.

[11] Patent Number: 5,454,141

[45] Date of Patent: Oct. 3, 1995

[54] CASKET STRUCTURE, LAMINATE COVERING THEREFOR, AND METHOD OF MAKING SAME

[75] Inventors: Leland D. Ozbun, Lynn, Ind.; John D. Soroka, Rochester Hills, Mich.

[73] Assignee: Elder Davis, Inc., Richmond, Ind.

[21] Appl. No.: 134,577

[22] Filed: Oct. 8, 1993

[51] Int. Cl.[6] ..... A61G 17/00

[52] U.S. Cl. ..... 27/4; 27/10; 27/19

[58] Field of Search ..... 27/2, 4, 10, 14, 27/19, 35; 229/939; 220/441, 443

[56] References Cited

U.S. PATENT DOCUMENTS

| | | | |
|---|---|---|---|
| 1,128,865 | 2/1915 | Freeman | 27/35 |
| 1,989,962 | 2/1935 | Zinser et al. | 27/5 |
| 3,344,973 | 10/1967 | Studen | 229/939 X |
| 3,544,419 | 12/1970 | Gerard | 229/939 X |

*Primary Examiner*—Kien T. Nguyen
*Attorney, Agent, or Firm*—Synnestvedt & Lechner

[57] ABSTRACT

A folded-up corrugated fiberboard casket having top and bottom framing members on its exterior is provided with a decorative covering in the form of a laminate comprising a layer of a pliable, foldable and creasible cellulosic material, for example E-flute corrugated fiberboard, bonded to a thinner decorative exterior layer of a material which is also pliable, foldable and creasible, for example wood-grain paper. The laminate covering obliterates minor irregularities on the exterior surfaces of the inner casket box, and also provides sharp profile angles for the casket. The laminate covering is preferably formed by providing a flat blank which is scored and cut-out at appropriate places and is self-supporting to facilitate application of the covering to the casket box. The blank is then folded, and the framing strips glued to the laminate. This assembly is then placed against and glued to the exterior of the casket box. The laminate preferably is folded back on itself to provide a strong double-thickness of material between the framing strips.

27 Claims, 7 Drawing Sheets

FIG. 1
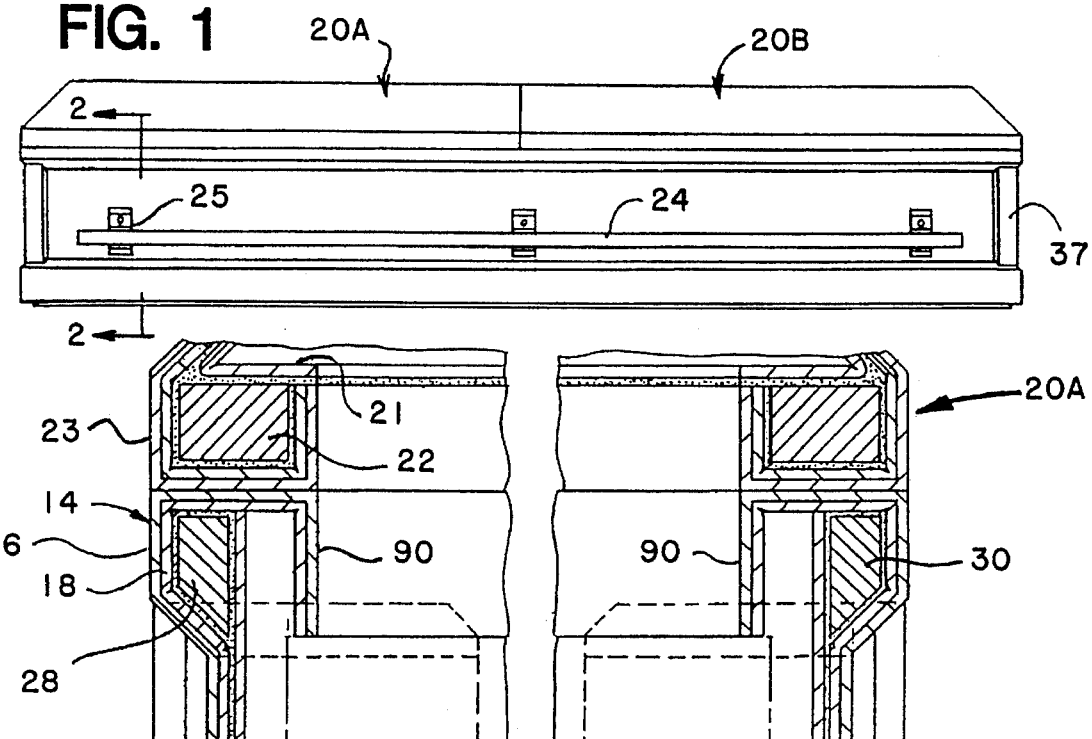
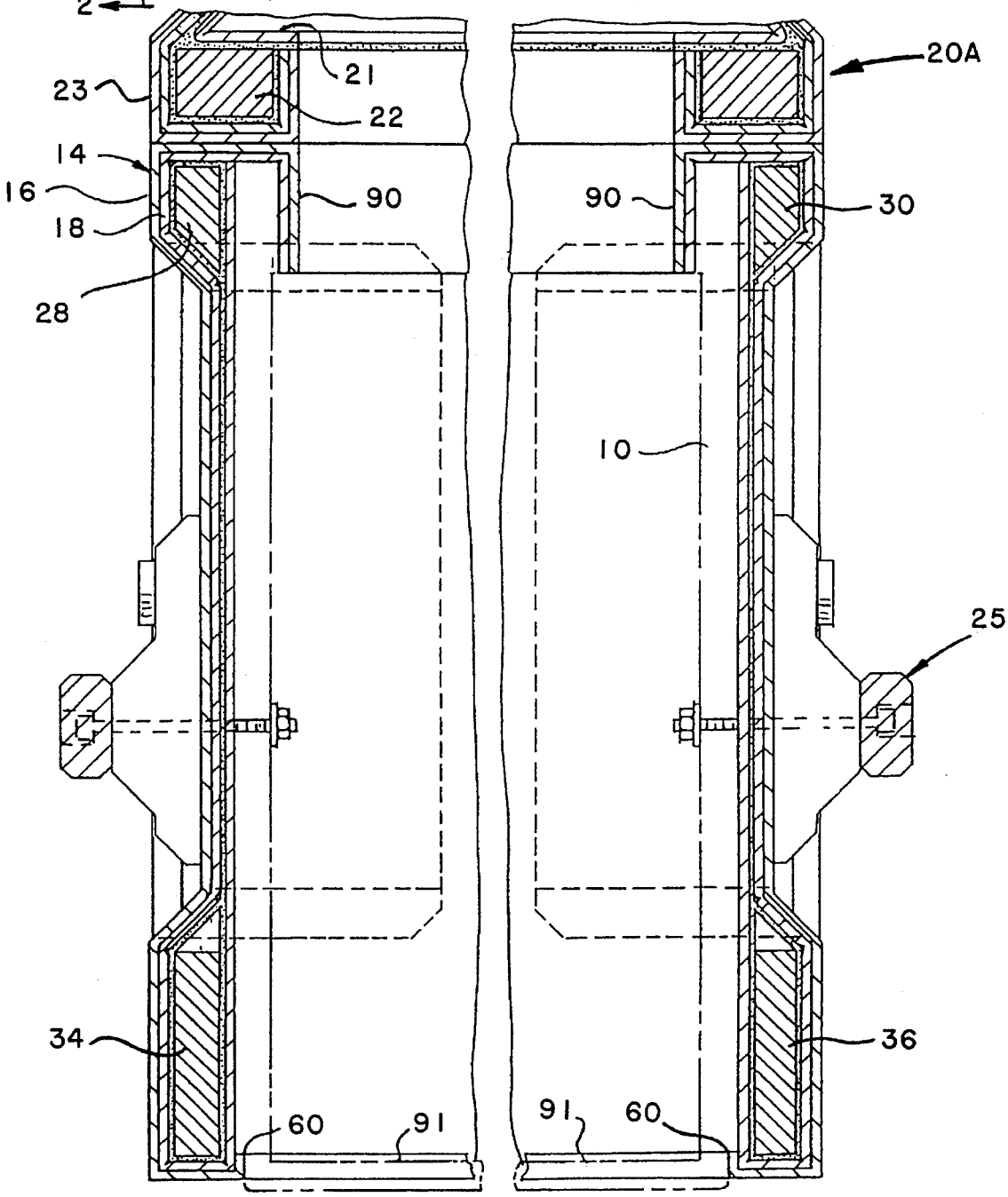
FIG. 2

FIG. 5
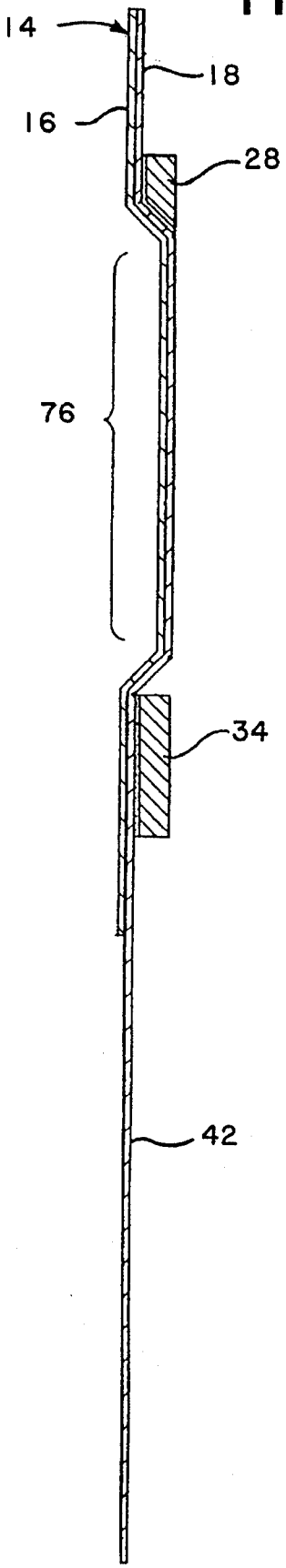
FIG. 6
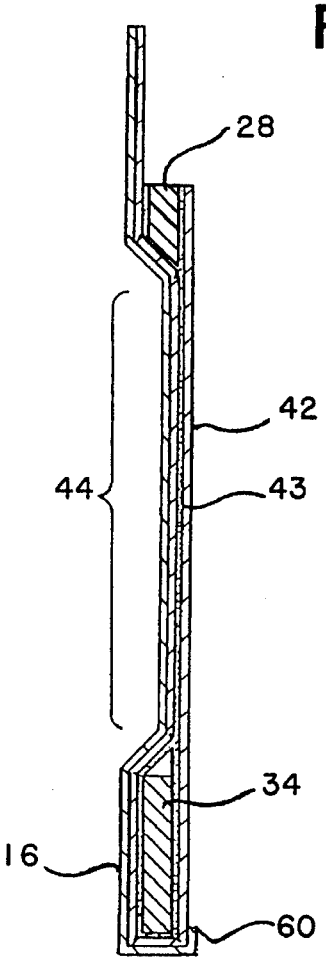
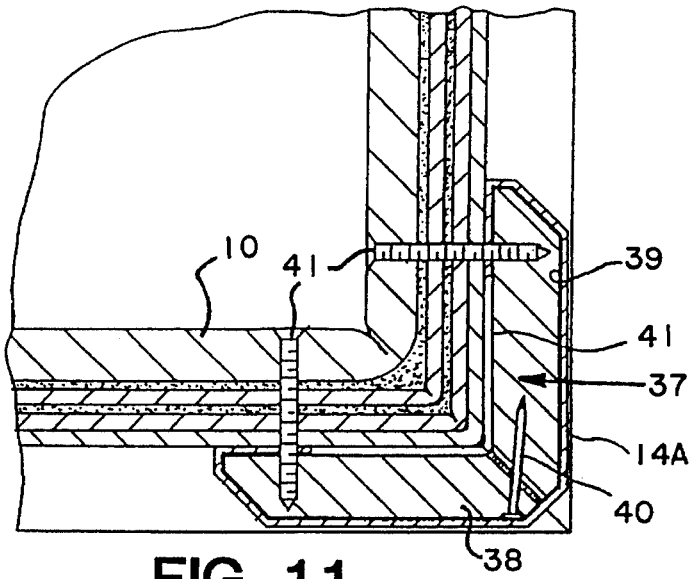
FIG. 11

CASKET STRUCTURE, LAMINATE COVERING THEREFOR, AND METHOD OF MAKING SAME

FIELD OF THE INVENTION

This invention relates to caskets for the final disposal of human remains, whether by burial, cremation, or otherwise. It relates especially to caskets of the type in which the inner box which supports the human remains is made of folded-up corrugated fiberboard or solid-paper fiberboard, and hence is very light and inexpensive.

BACKGROUND OF THE INVENTION

It is known to make caskets for the final disposal of human remains by scoring and cutting a flat blank of corrugated fiberboard and then folding it up to form a casket body for receiving the corpse. Such caskets and methods for making them are disclosed, for example, in U.S. Pat. No. 4,967,455, issued Nov. 6, 1990 and U.S. Pat. No. 4,773,134, issued Sep. 27, 1988. In such caskets the casket body itself is preferably covered interiorly with a liner, and its exterior is provided with a decorative covering. To provide requisite strength and rigidity, such a corrugated fiberboard inner box is usually provided with rigid framing members, which may be of wood or wood substitute material, usually extending around the outside of the inner box, near its bottom and near its top, and appropriately secured thereto; these framing stripes are customarily placed on the outside of the casket, and finished attractively to add to the pleasing appearance of the casket. A decorative covering of the inner box is required for commercial purposes, since a plain corrugated fiberboard inner box is normally not sufficiently attractive to be saleable. In some cases the inner box and/or the truss for the casket lid may be of particle board, for example, or other light-weight foldable material.

To enhance the external appearance of the casket box, the decorative outer covering may be provided by applying paint or a paint-like material to the exterior, or by papering it with a material similar to ordinary thin wallpaper. The principal difficulty with such an approach is that the applied covering tends to follow closely unavoidable irregularities in the exterior surface of the corrugated fiberboard box, which then "show through" and do not present the desired perfectly smooth exterior appearance. In addition, the inner box itself typically has edges which are rounded due to the inherent properties of the box material when folded, and hence does not present as sharp and angular a profile at its edges as is desired from the aesthetic viewpoint; paint or thin paper does not hide this. Furthermore, ordinary decorative paper applied to the usual corrugated fiberboard inner casket box has been found to have a tendency to split when applied to the casket, especially where it is wrapped around the edges of the box.

Accordingly, it has been common in the past to utilize as an exterior covering a relatively thick pliable material such as a heavy cloth or flexible non-woven synthetic material, preferably cemented to the exterior of the inner box and of a thickness sufficient to disguise irregularities of the outer surface of the inner box and present a reasonably smooth exterior appearance. However, from a commercial viewpoint even such a covering suffers in that its appearance is not pleasing to all persons. For example, many persons will find a smooth wood casket, or a smooth metal casket, especially with sharply-angled edges, to be much more attractive and desirable. The difficulty is that the latter type of caskets are quite expensive, and hence not readily affordable for certain purposes where high expense cannot be tolerated.

U.S. patent application Ser. No. 07/965,911 of B. E. Elder and S. D. Woedl, filed Oct. 23, 1992 and of common assignee herewith, discloses and claims a casket structure using a corrugated fiberboard inner box which nevertheless presents the smooth, expensive-looking exterior appearance of a high gloss plastic or metal casket. This is accomplished, in essence, by forming thin panels of plastic or metal that are pre-shaped to conform closely to the outer surfaces of the inner box including the usual framing strips on its exterior; this self-supporting cladding is bolted onto the exterior of the underlying corrugated fiberboard box, the combination then being sufficiently strong for its intended purposes and presenting the appearance of a much more expensive casket.

A drawback of the latter type of casket structure is that it is, in the case of plastic materials, best made by molding or thermal forming processes which by their nature are rather critical and rather expensive to perform. If instead of molding, one were to attempt to make such a plastic or metal cladding by simple inexpensive bending processes, there would be the danger of stretching or damaging the material, particularly at corners and edges, thereby producing substantial marring of the appearance of the finished casket.

What is desired for many purposes is a casket structure utilizing a light-weight, inexpensive inner box which, nevertheless, presents at its outer surface an appearance comparable to that of a more expensive casket, for example presenting a wood-grain appearance or a smooth plastic or metal appearance, preferably with sharply-defined angles at its edges, but which nevertheless is easy and inexpensive to manufacture.

SUMMARY OF THE INVENTION

In accordance with the invention, these and other objectives are attained by the provision of a casket structure comprising a casket box for receiving human remains and a laminate cladding secured to the exterior of the casket box; preferably this laminate comprises a first layer of a cellulosic material which is pliable, foldable and creasible, but not limp, adapted to lie against the exterior walls of the casket box and to extend around the edges thereof, and a second layer of a pliable, foldable and creasible decorative material, preferably substantially thinner than said first layer and laminated thereto. This laminate covering is pre-scored and pre-folded to provide creases therein conforming it generally to the edges of the casket box when placed against and around them, with the creases therein providing sharply angled contours on the exterior of the covering where it traverses casket edges. This outer covering is placed in generally-conforming relation to the exterior of the inner box and secured thereto, as by gluing. Preferably the covering is made in two substantially identical halves, each extending from the middle of one end of the inner box, along one side, and thence to the middle of the other end of the box.

Also in the presently preferred embodiment, rigid framing strips are provided which extend around the bottom and the top of the sides of the inner casket box to provide the usual appearance of a casket and to strengthen the casket box; preferably the covering is first wrapped around each such framing strip as described herein, and the combination of covering and framing strips then glued or otherwise secured to the inner box. To provide stiffening of the covering and for convenience in assembly, the covering preferably extends around the outside of the framing strips and back on itself, to form a double thickness of the covering between the strips. Appropriate scoring and stamping of the starting blank is preferably provided so that, as described, the covering is easily applied around the framing strips, over the top edges of the box and around the ends of the box as desired.

In a preferred embodiment in which the outer thin skin is wood-grain paper and the laminate to which it is secured is E-flute corrugated fiberboard, the resulting assembly on the inner box presents the external appearance of a fine wood casket, with sharply defined profile features at its edges and with attractive smooth surfaces, yet it is easy and inexpensive to make.

The presently preferred method of making the casket structure is first to provide a flat blank of cellulosic material fiberboard to which a thin decorative sheet has been glued. The blank is of a length to extend from the center of one end of the casket to the center of the other end. The latter blank is scored where folds are to be made in it, and stamped out at various corner locations to provide the desired folding and butting of the ends of the covering at the corners of the casket when assembled, without leaving large gaps and without requiring overlapping. The framing strips are glued in the desired positions on the blank, and the laminate is wrapped around the lower framing strips and back on itself, then upward over the inner surface of the upper framing strip, to its top edge; preferably the decorative covering is removed from the side of the laminate which contacts the inner box between the upper and lower framing strips, to permit better gluing of the cladding to the inner box. The original extreme top edge of the blank is left extending straight upwards until the latter steps have been accomplished, and then is folded inwardly across the top of the top framing strips and downwardly along the inside of the inner box. The covering having been previously coated with a layer of an appropriate glue, when the blank has been scored, bent up and placed in the position described, it need only be left in position while the glue sets. Upon similar processing and application of the other half of the covering, the completed casket structure is obtained.

In other embodiments, the outer layer of the laminate need not be wood-grain paper; for example, a plastic or mylar film or metal foil may be used for the outer layer to give the pleasing appearance of a plastic or metal casket. Also, one can use solid-paper fiberboard in place of the E-flute. Furthermore, the cladding is not limited to being applied to an inner casket body of corrugated fiberboard, but may be applied, for example, to a particle board inner casket body or lid.

BRIEF DESCRIPTION OF THE DRAWINGS

These and other objects and features of the invention will be more readily understood from a consideration of the following detailed description, taken with the accompanying drawings, in which:

FIG. 1 is a side elevational view of a completed casket, including its lid, made according to the present invention;

FIG. 2 is a vertical section, taken along lines 2—2 of FIG. 1, broken apart at its center to conserve space in the drawing;

FIG. 5 is a vertical sectional view of the blank with the framing strips glued thereto;

FIG. 6 is a view like that of FIG. 5, with the lower portion of the blank folded upward along the other side of the laminate and the other sides of the framing strips, to which it is glued;

FIG. 11 is an enlarged fragmentary sectional view of a corner of the corrugated casket with both the covering and additional decorative corner pieces in place;

DETAILED DESCRIPTION OF PREFERRED EMBODIMENTS

Figure 15:
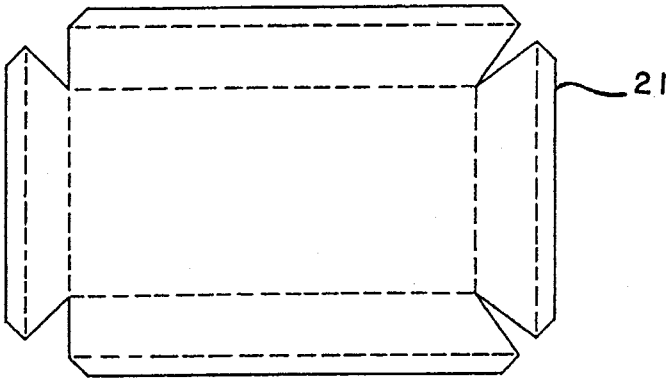
FIG. 15 is a plan view of the die cut and scored corrugated fiberboard truss which, during assembly, is glued at its periphery to the wooden frame.
Figure 14:
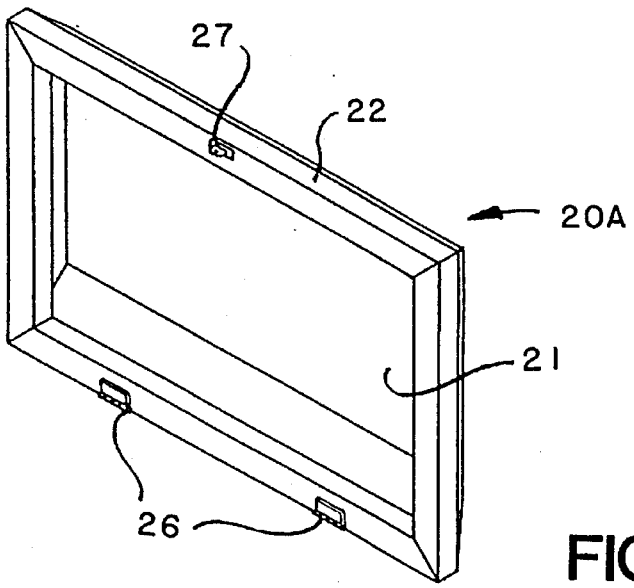
FIG. 14 is a perspective view of the assembled lid.

Referring now to the embodiment of the invention shown in the drawings, and without thereby in any way limiting the scope of the invention, FIGS. 1 and 2 show a completed casket made in accordance with the invention. An inner box 10, which is preferably of double-wall or triple-wall corrugated fiberboard, is preferably made from a folded-up fiberboard blank as shown and described in the above-cited earlier patents. It is covered by a laminate 14 comprising an outer layer 16 of a thin decorative, pliable and creasible material such as 3-mil thick wood-grain printed paper, glued to an inner layer 18, preferably constituted of E-flute fiberboard; this laminate is glued to the exterior of the casket box and shaped to conform generally to the shape of the exterior of the casket box, and to extend around its edges. A two-section lid 20A, 20B is also provided, which in this example is made of a corrugated fiberboard truss 21 (FIG. 15) glued to a wooden frame (FIG. 14) and covered with a laminate 23 (FIG. 16) consisting in this example of 3-mil thick wood-grain paper glued over solid-paper fiberboard. Also provided for the casket are usual side handles such as 24, and fastening systems such as 25 for bolting the handles to the inner casket box, through the covering. Hinges 26 (FIG. 18) and latches 27 are also provided for the lid.

Four top framing strips such as 28, 30 (FIG. 2) and 34 (FIG. 4) extend entirely along both sides and the ends of the exterior of the casket box, and are covered by the laminate covering 14. In this example, framing strips such as 34, 36

(FIG. 2) extend around the lower periphery of the box 10, and are also covered by the laminate covering 14. The framing strips are preferably of an inexpensive material such as layered fiberboard or cardboard, or particle board.

Also in this example, for appearances sake each vertical corner edge of the casket box is preferably covered by a right-angled wooden assembly such as 37 (FIGS. 1 and 11), extending between the upper and lower framing strips; these corner pieces are also preferably covered with decorative laminate 14A. Each such corner assembly comprises a first vertical piece 38 glued and secured to another similar vertical wooden piece 39, as by nails 40, as shown. The corner assembly is attached to the box by ordinary screws 41 driven into the corner pieces from the inside of the casket.

Figure 9:
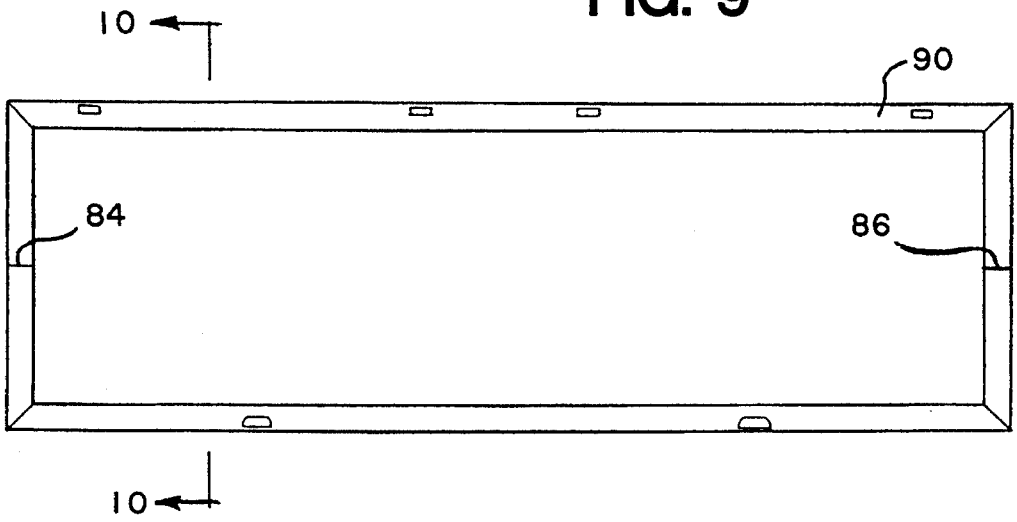
FIG. 9 is a top view of the casket box with its covering in place.

As shown in FIG. 9, the covering for the casket box is preferably made in two pieces, each extending from the middle of one end of the box to the middle of the other end, for convenience in manufacture and assembly.

As shown especially clearly in FIGS. 2 and 6, and as described fully hereinafter, the laminate 14 in this example extends over the top and bottom framing strips such as 28 and 34, which are glued to the laminate before application of the complete covering to the box; a portion 42 of the inner layer of corrugated fiberboard is folded back on itself and glued by glue layer 43 (FIG. 6) to the inner side of the outer run of laminate to provide a double-run 44 of material, providing a stiffer assembly for convenience in assembly as described more fully hereafter.

An important result of this arrangement is that the laminate covering provides the appearance of a very attractive casket, which is nevertheless inexpensive and easy to make. In this example, it presents the appearance of a fine wood casket; if the outer decorative layer 16 is of plastic or metal, the finished product has the appearance of a fine plastic or metal casket. This appearance is enhanced by the ability of the laminate covering to hide small irregularities in the exterior of the corrugated fiberboard inner box, for example those due to the fluting in the corrugated fiberboard of the inner box, especially near its edges; the external appearance of the fiberboard casket is especially enhanced by the ability of the covering to assume and maintain sharply angled bends at edges of the casket box, including the framing strip edges, thereby presenting a sharply-defined profile as desired. FIG. 2 shows this for the covering overlying the framing strips.

It will be understood that the drawings are somewhat idealized in certain respects. They do not show the small surface irregularities on the exterior of the casket box which the covering obscures; furthermore, the thickness of the layers of the laminate covering and of the adhesive have been exaggerated in some cases in order to show them clearly. The thin layer of glue between the layers of the laminated covering has not been shown in some cases because of its extreme thinness. In actuality, in a typical example the wood-grain paper is about 3 mils in thickness and the E-flute corrugated fiberboard inner layer of the covering is about 1/16 inch thick; if solid-paper fiberboard is used, as in the lid in this example, it is typically about 0.026 mil in thickness. The adhesive is typically an ordinary layer of a conventional white glue, used both to hold the laminate layers together and to hold the covering to the inner casket box.

Aside from the high-quality appearance obtained by use of the invention, an important advantage lies in the ease and reliability of manufacture of the product. In the case of the plain cloth covering used in the prior art, the covering was applied manually; the desired general shape was cut out, glue was applied to the casket exterior including the framing strips (which were first glued to the casket box), and then the cloth covering was manually spread and smoothed over the exterior of the box and framing strips, with appropriate hand poking and smoothing where appropriate to obtain the desired smooth covering. This has been an operation requiring trained and skilled personnel, and inevitably results in some variations between products and some rejects for unacceptable appearance of the covering, due to less than optimum manual application.

In the preferred method for making and assembling the casket structure of the invention, an original blank of laminate is prescored and die cut by machine, rather than by hand operations, so that the desired dimensions and location of the folds are accurately and reproducibly provided; in addition, the covering is self-supporting so that it can be easily picked up, placed along a side and an end of the casket box, the end flaps and top flaps bent over along their score lines, and the assembly merely pressed against the lid to effect the desired gluing, with the glue layer extending over the covering and/or box. Preferably the desired folds and creases along the score lines are effected by placing the scored blank into a vacuum jig or mold having a mold face simulating at least the frame strip contours, to pull the laminate against the mold face and effect the desired folding and creasing. Thus even this aspect of the manufacturing and assembling procedure can be mechanized.

The following description of a preferred embodiment of the method of making the casket structure of the invention provides further details of the method and of the preferred construction.

Figure 3:
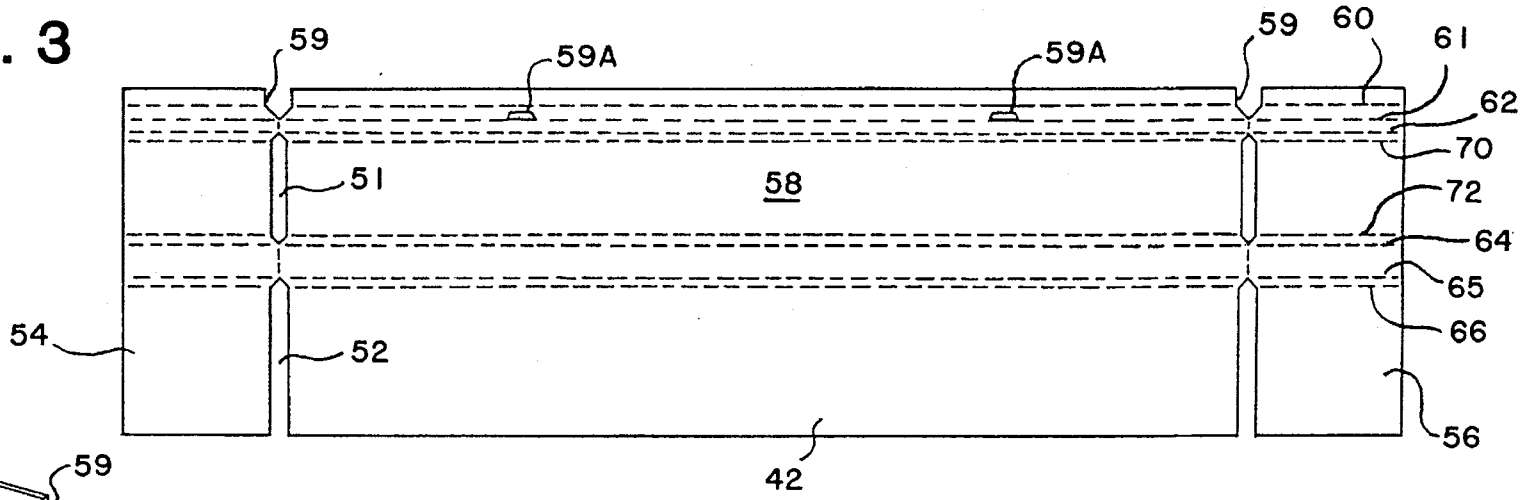
FIG. 3 is a plan view of a laminate blank as cut and scored in an early step in the fabrication of the casket, in accordance with the invention.

More particularly, FIG. 3 shows a scored and stamped blank 48 of cladding material which, as shown in FIG. 5, is in this example made up of the outer wood-grain paper 16, typically about 3 mils in thickness and, glued thereto by a layer of glue (not shown), a layer or lamina of E-flute corrugated fiberboard 18, typically about 1/16 inch in thickness. The broken lines in FIGS. 3 and 4 indicate scoring lines in the blank which enable the blank to be folded easily along the score lines; the stamped cutouts such as 51 and 52 provide clearances so that, when the end flaps such as 54 and 56 of the blank are folded around the ends of the casket, the ends of the main side panel 58 of the blank will mate and substantially butt with the adjacent folded end flap of the casket box as desired. 59 and 59A designate notches for the placement of latches on the front side only of the casket, by which the casket lid may be secured to the main body of the casket. Only one scored blank is shown in FIG. 3, but it will be understood that two such blanks are utilized to accomplish complete cladding.

As pointed out above, the outer decorative layer 16 of the laminate covering need not be of wood-grain paper, but may be of other thin, pliable material, for example plastic or metallic film or cloth having enough resilience that it can be bent around corners without splitting or change in appearance.

The scoring of the blank is performed on the E-flute side of the laminate blank. Score lines 60, 61, 62, 64, 65, 66 are provided by a crushing action which does not actually pierce the corrugated E-flute, while score lines 70 and 72 are actually slits extending about ¾ of the way through the corrugated E-flute. This is because lines 60, 61, 62, 64, 65, 66 define lines along which the laminate covering is folded toward the E-flute side, with the paper layer on the outside of the fold; this folding is adequately facilitated by crush-type scoring. The slit score lines 70, 72 are located where the laminate covering is folded outwardly (toward the paper side) so as to fit in the angles between the lower sides of the top framing strips and the adjacent vertical wall of the casket box, and in the angles between the top of the lower framing strips and the adjacent vertical casket wall; the slitting facilitates this outward folding.

Figure 4:
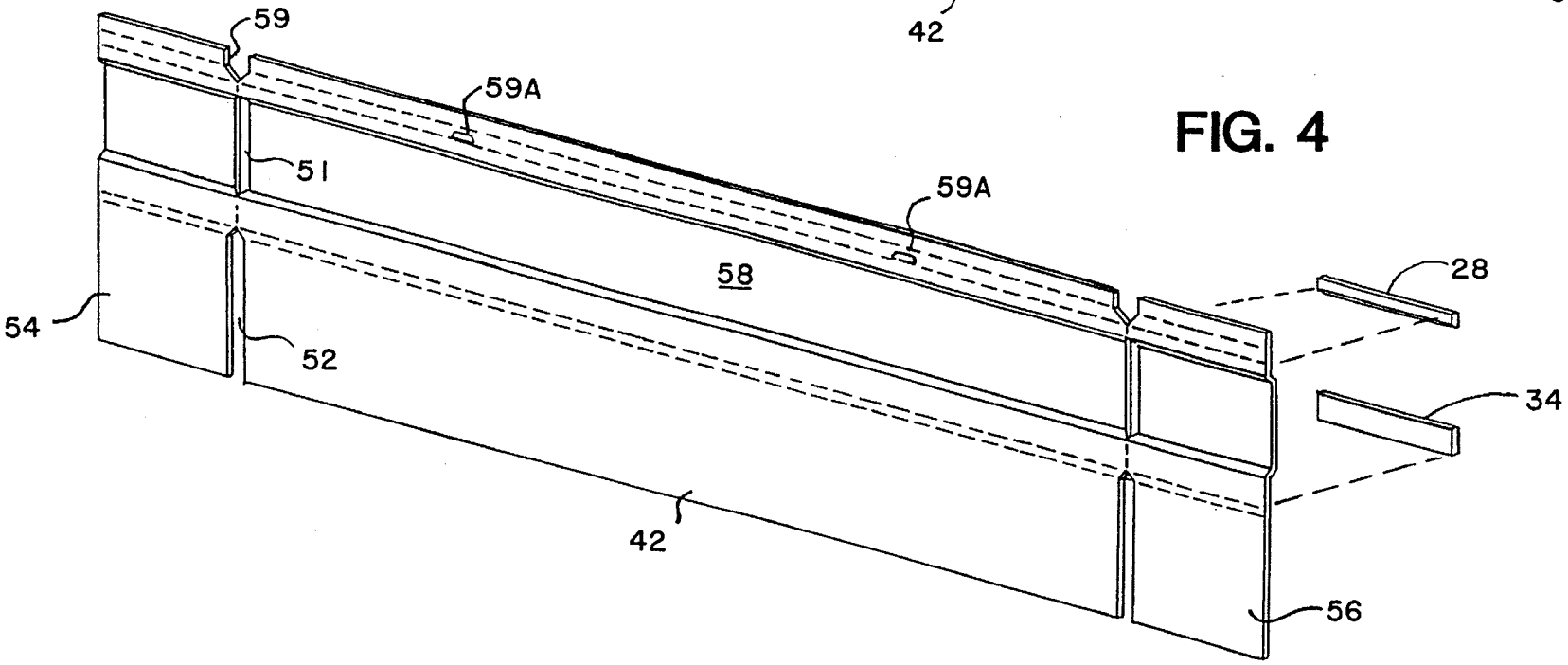
FIG. 4 is a perspective view of the same blank after it has been folded to receive a side framing strip and, at each end, an end framing strip.
Figure 7:
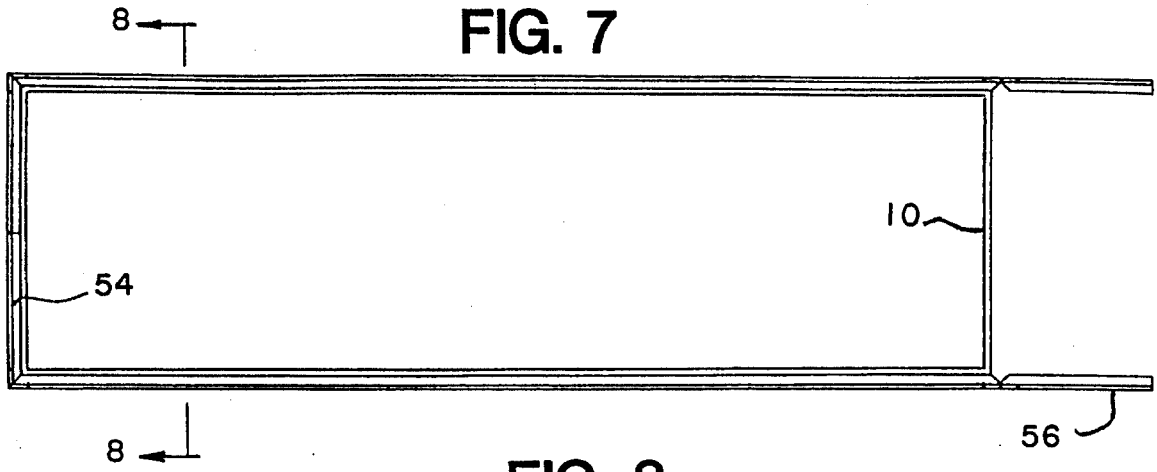
FIG. 7 is a top plan view of the casket with the covering in place along two sides and one end, prior to folding it around the other end.

After covering the rear side (opposite from the face shown in FIG. 3) of the scored cladding blank with an appropriate glue, the blank is bent into the shape shown in FIGS. 4 and 5, and the upper and lower framing strips such as 28, 34 are placed in position against it and glued as also shown in FIGS. 4 and 5. Next, as shown in FIG. 6, the lower portion 42 of the original blank is folded upward, around the lower framing strips such as 34, then is extended further upward over and against the cladding portion 76, thence to the top end of the top framing strip 28. The two courses of laminate cladding thus formed adjacent each other are glued together between the upper and lower framing strips, to form the single relatively-strong and self-sustaining wall 44. It is noted that the outer decorative layer 16 of paper terminates at 60, just upward of the point at which it folds around the lower edge of the bottom framing strip, thereby leaving exposed the remainder of the E-flute cladding above it. This is done because the E-flute corrugated fiberboard glues more easily to the exterior of the casket box than would the paper layer if it were present.

Figure 10:
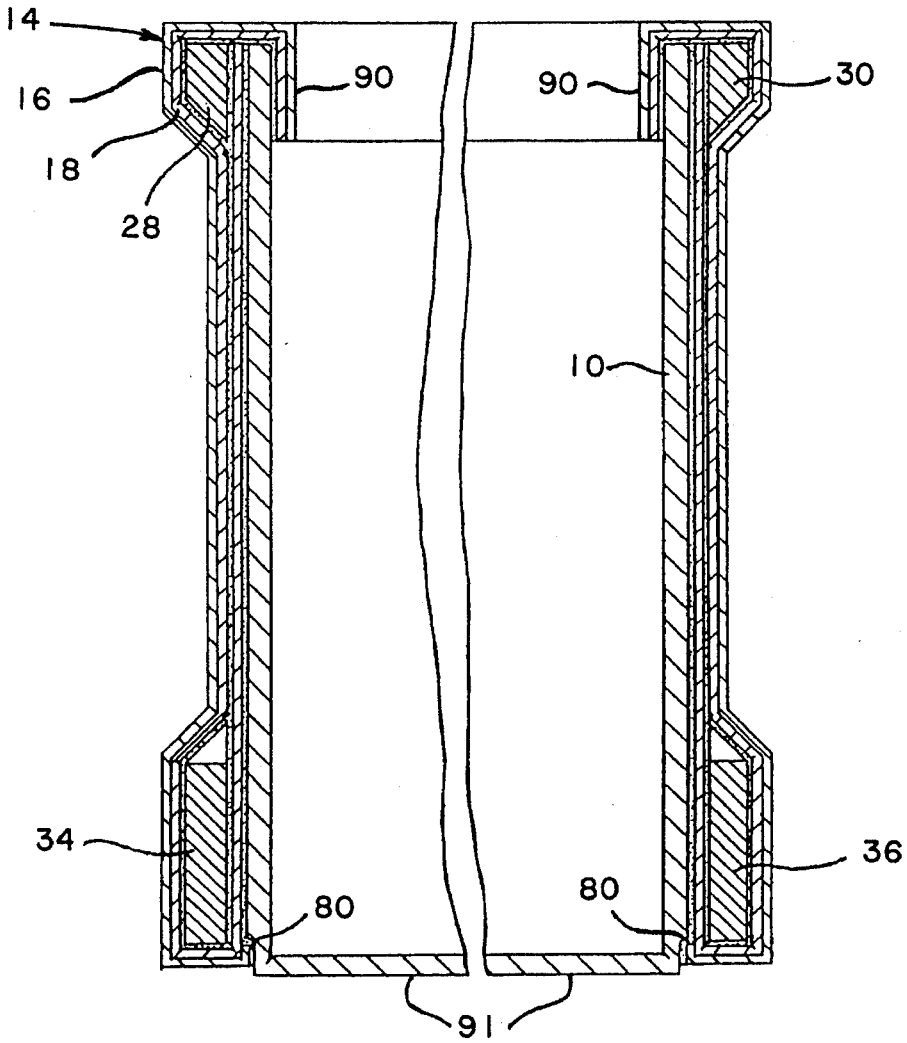
FIG. 10 is a vertical sectional view of the casket body with its covering in place.

The resultant unitary cladding of FIG. 6 is then placed with its double-thickness center panel 44 extending along one of the vertical side walls of the inner box 10; the two end flaps 54 and 56 (FIG. 4) are then folded about the two opposite ends of the casket, and terminate at the centers 84 and 86 of the ends of the casket where shown in FIG. 9. The top flaps such as 90 (see FIG. 8) of the original blank are then folded inwardly across the top of the upper framing strips such as 28 and 30 and across the top of the top edge of the adjacent inner box, then downwardly against the adjacent inner surface of the box to assume the position shown in FIGS. 9 and 10; the above-described glue holds the cladding in this folded position, while the previously applied scoring makes it easy to accomplish the folding and to maintain the folded blank in the desired position while the glue cures.

Figure 8:
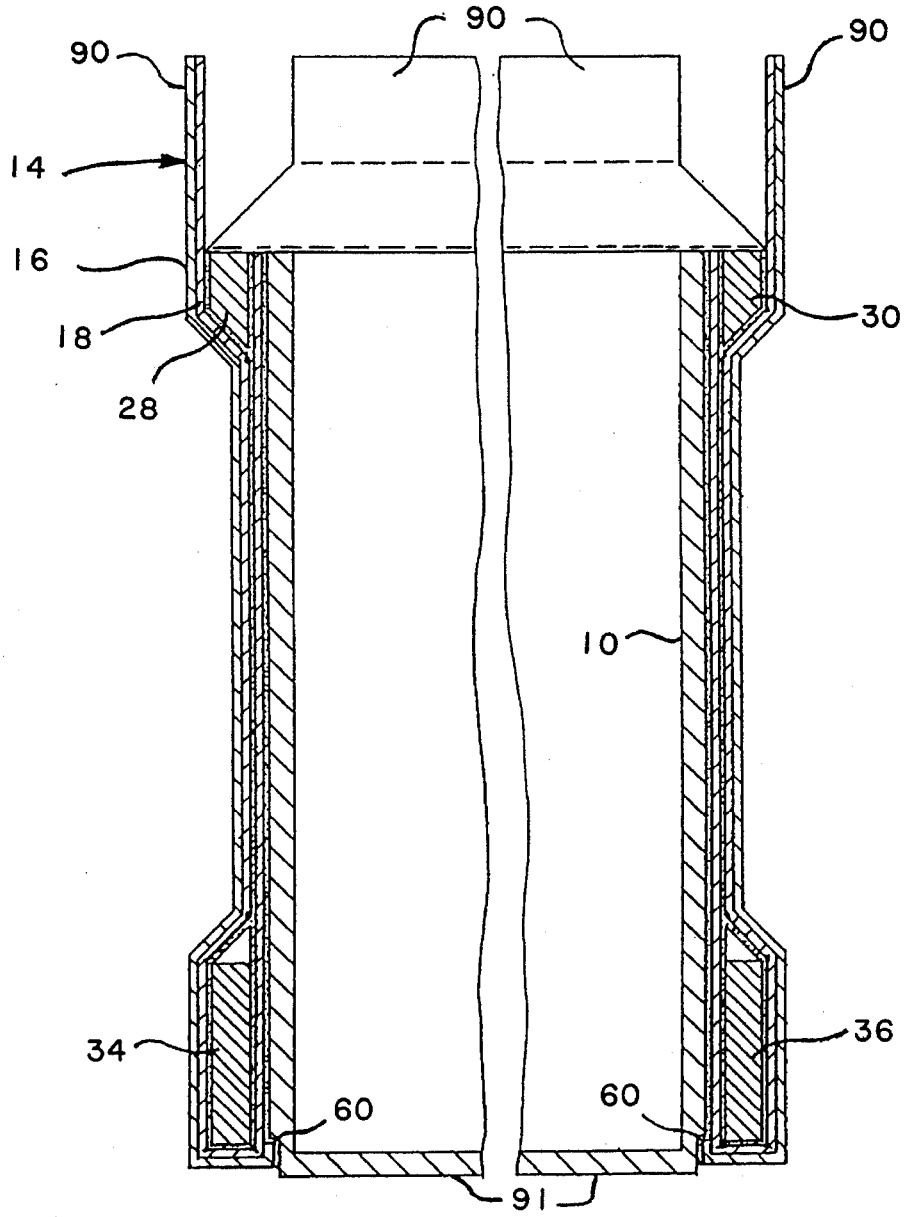
FIG. 8 is a vertical sectional view of the casket just prior to folding the covering over the top of the casket wall.

As shown in FIG. 8, the lower end of the lower framing strips such as 34 and the cladding over it are preferably positioned slightly above the outside of the bottom 91 of the inner box, so that the box may be moved and slid about on abrasive surfaces, on its bottom, without damaging the outer skin of the cladding.

The usual side handles 24, as well as the optional wooden corner assemblies such as 37 at each corner may then be applied as discussed above, to complete the casket illustrated in FIG. 1.

When using a wood-grain paper as the outer layer of laminate covering, the completed casket presents an excellent simulation of a high-quality wood casket, having both the requisite strength and an excellent appearance, yet is made easily and inexpensively so that both its appearance and cost are highly attractive to buyers.

The ability of the laminate to be folded accurately and sharply makes it possible to achieve sharp corners and edges as desired for excellent appearance, yet provides a sufficient covering and smoothing-out of irregularities in the underlying inner casket box that the outer skin presents the smooth appearance of a fine wood cabinet; furthermore, the lamination prevents the decorative paper from splitting when it is wrapped tightly about the inner box and framing strips during fabrication.

Accordingly, there has been provided a casket structure comprising a lightweight inner box for receiving and supporting human remains, covered on its outer side with a decorative cladding conforming to the outer configuration of the inner box and secured thereto permanently, the cladding being made up of a laminate of an outer flexible thin skin of decorative material laminated to a thin layer of a self-supporting but readily bendable and creasible material, preferably a cellulosic material such as E-flute corrugated fiberboard, although other materials such as solid-paper fiberboard may be used instead. The outer skin of wood-grain paper provides a casket having the appearance of a high quality wood casket; other outer skins, such as mylar or plastic, produce the appearance of a smooth and/or glossy plastic or metal casket. The cladding is self-supporting and pre-scored and pre-folded so that it can be picked up as a unit and placed against the casket box as a unit, ready to be glued thereto.

Figure 16:
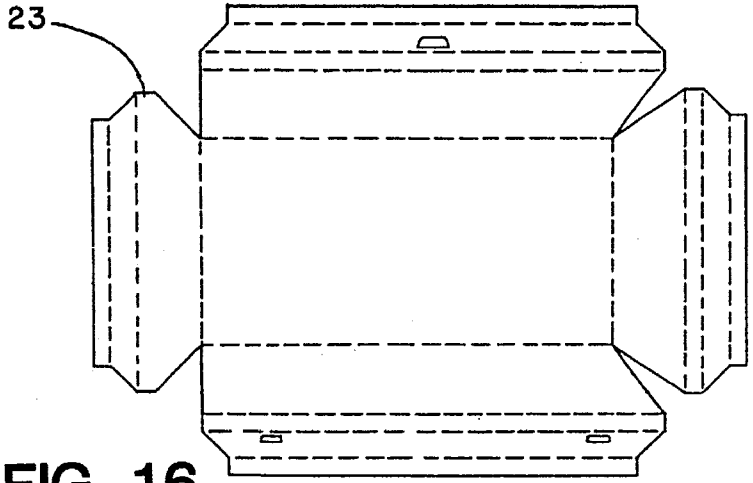
FIG. 16 is a plan view of the laminate blank constituting the covering which is glued over the truss during assembly of the lid.
Figure 12:
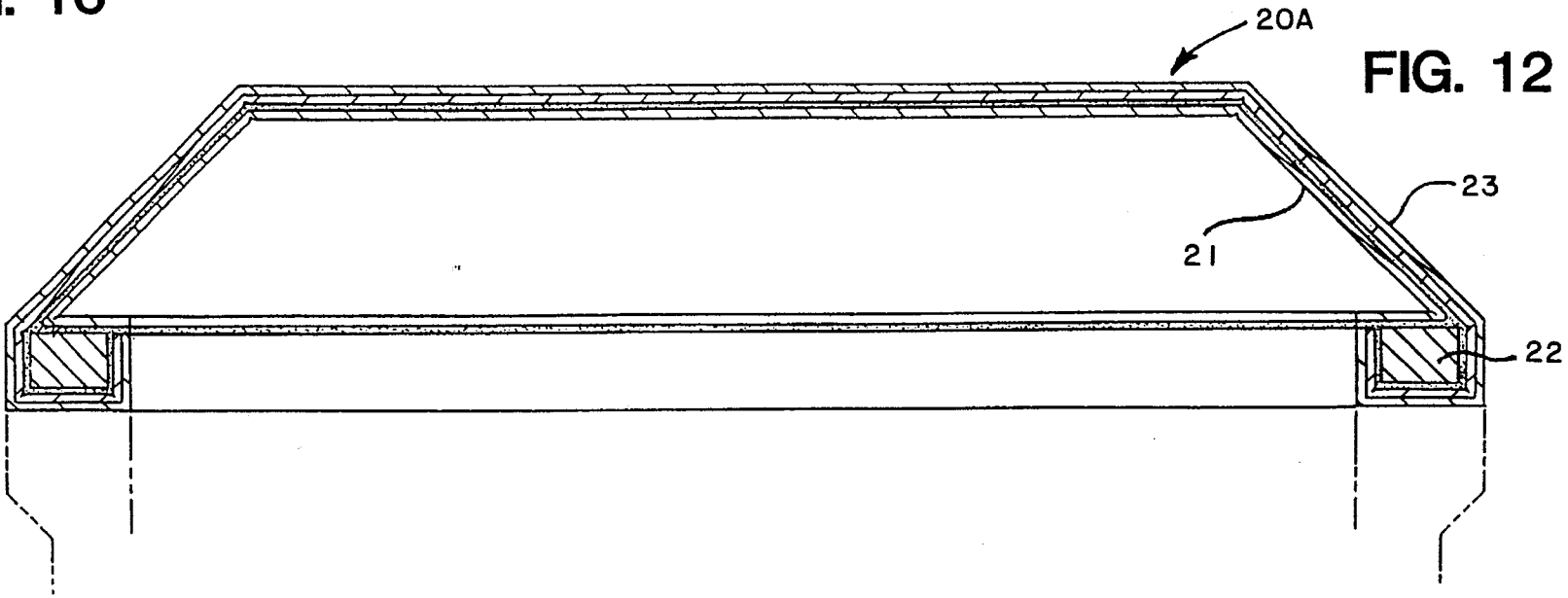
FIG. 12 is a vertical sectional view showing a casket lid made in accordance with the invention in one of its aspects, without latches and hinges.
Figure 13:
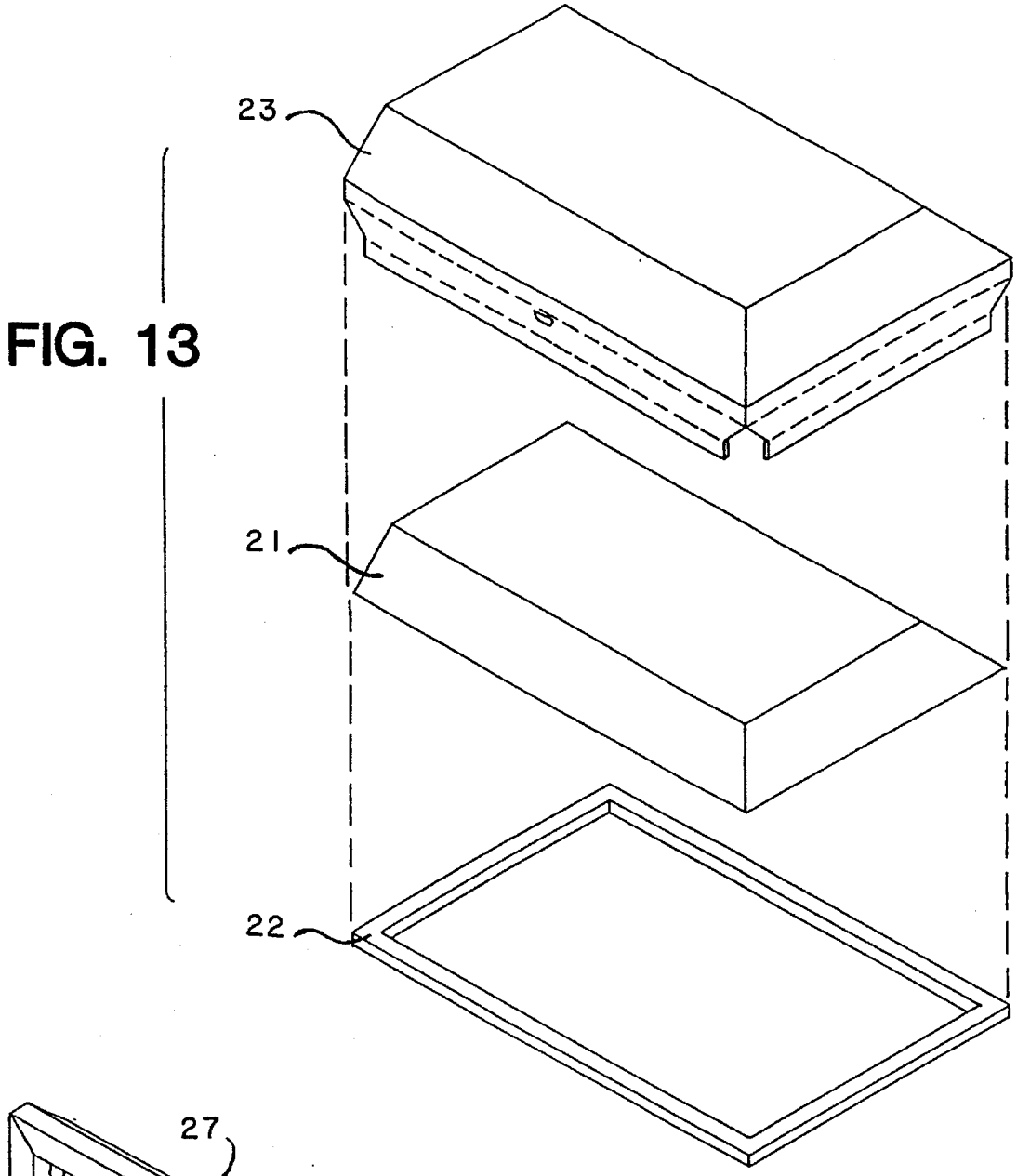
FIG. 13 is an exploded view of the lid showing its three main parts separated from each other for clarity.

FIGS. 12 through 16 show a form of lid, actually one half of a split lid, made in accordance with one aspect of the invention and using a laminate of thin wood-grain paper adhered to a thicker layer of solid-paper fiberboard as a covering. To make this lid, the top of a rectangular wooden frame 22 (see FIG. 13), made of four wooden rails of square cross-section joined at their ends, is glued to corrugated truss 21 around its entire perimeter, leaving the sides and bottom of the frame exposed; the laminate covering 23 of wood-grain paper or solid-paper fiberboard is then glued onto the top of the truss to form the completed lid. Hinges 26 and latch 27 are preferably provided on the wooden frame where shown in FIG. 14. The laminate for the lid covering is pre-cut and pre-scored as shown in FIG. 16, to facilitate its wrapping around the wooden rails. The wood-grain paper is again preferably about 3 mils in thickness, and the solid-paper fiberboard about 0.026 inch in thickness.

While the invention is especially advantageous in its preferred embodiment described above, in which it is applied to a pre-scored, pre-folded cladding of a length to extend along the length of its casket and around one end corner thereof, with upper and lower horizontal framing strips in both the portion of the cladding which covers the length of a side of the casket and the portion of the cladding which is folded around the end corner, at least some of the advantages of the invention may be realized in other embodiments thereof. As examples, a single section of such cladding may be formed to cover only one side or one end of the casket and applied separately thereto. More or less than two framing strips or similar protrusions may be provided on a side or end portion of the cladding, and in some cases the framing strips or other longitudinal strips may be initially present on a part of the exterior of the casket and the laminate covering applied over them while they are on the box. Further, the vertical corner pieces described above, although often desirable for best appearance, need not be used in all cases. It is also recognized that in embodiments in which the framing strips are applied to the laminate prior to installation on the casket, as preferred, in some cases the sides of the framing strips applied against the casket need not be covered by this laminate, and the increased thickness of material desired between the top and bottom framing strips may instead be provided by a separate strengthening layer of material. In addition, in some cases the top of the cladding need not extend across the top edge of the casket and downwardly along the inside of its sidewalls, but may terminate short of such position.

The laminate covering according to this invention may also be used as the covering for a casket box made by the fold-up process described and claimed in U.S. patent application Ser. No. 08/033,203, filed Mar. 16, 1993 in the names of S. D. Woedl, J. D. Soroka and G. H. Davis, with the laminate described above adhered to the casket box blank before it is folded up into its box shape. In this embodiment, a flat three-layer blank is first formed, two layers of which are constituted by the above-described appropriately-scored two-layer laminate with the framing strips attached as described above, and a third layer of appropriately-scored corrugated fiberboard which when folded up will constitute the structural casket box as described in the above-identified application Ser. No. 08/033,203. This complete pre-scored three-layer assembly is suitable for later folding up to provide the desired casket, with the laminate and framing strips glued to the outside. For example, the original blank may be made up of a laminate of wood-grain paper glued to E-flute corrugated fiberboard, which laminate in turn is glued to a flat sheet of ¼ inch thick corrugated fiberboard, all this having been appropriately scored so it can be later folded up into the desired casket box shape, after which any desired handles and fasteners can be applied. This permits the main elements of the casket to be shipped in the form of a flat blank which is easily folded up and assembled at the point of sale or use.

While the invention has been described with particular reference to specific embodiments in the interest of complete definiteness, it will be understood that it may be embodied in a variety of forms diverse from those specifically shown and described, without departing from the spirit and scope of the invention.

What is claimed is:

1. A casket structure comprising:

an inner structurally-sound casket box for receiving and supporting a human body; and a thin pliable, foldable and creasible outer cladding secured to and against the exterior of said box and conforming thereto, and thinner than the walls of said casket box;

said outer cladding comprising a layer of cellulosic material covered on its exterior with a thin sheet of decorative material laminated thereto.

2. The casket structure of claim 1, wherein said thin sheet of decorative material is a wood-grain paper.

3. The casket structure of claim 1, wherein said thin sheet of decorative material is of printed paper.

4. The casket structure of claim 1, wherein said decorative material is a metallic film.

5. The casket structure of claim 1, wherein said cellulosic material comprises E-flute corrugated fiberboard.

6. The casket structure of claim 1, wherein said cellulosic material comprises solid-paper fiberboard.

7. A casket structure, comprising:

an inner casket body of corrugated fiberboard;

at least one framing strip secured to the exterior of said inner casket body and extending outwardly therefrom; and a conforming layer of pliable, foldable and creasible cladding, adhered to and extending over and against the exterior of said casket body and said at least one framing strip;

said cladding comprising a first layer of corrugated fiberboard thinner than said fiberboard of said inner casket body, and a second layer of decorative paper-like material bonded to the exterior of said first layer.

8. The casket structure of claim 7, wherein said at least one framing strip extends entirely across one horizontal dimension of said inner casket body.

9. The casket structure of claim 7, wherein said at least one framing strip comprises a first set of four horizontal framing strips each extending entirely across the exterior of a different one of the outer sides and ends of said inner casket body near its top, and a second set of four additional horizontal framing strips each extending entirely across the exterior of a different one of the sides of said inner casket body near its bottom.

10. The casket structure of claim 7, wherein said second layer of decorative material is of paper.

11. The casket structure of claim 7, wherein said second layer of decorative material is of wood-grain paper.

12. The casket structure of claim 7, wherein said first layer is of E-flute corrugated fiberboard.

13. The casket structure of claim 7, wherein said inner casket body is of double-wall corrugated fiberboard.

14. The casket structure of claim 9, wherein said second layer is of wood-grain paper, said first layer is of E-flute corrugated fiberboard and said inner casket body is of double-wall corrugated fiberboard.

15. The casket structure of claim 14, wherein said inner casket body, said E-flute corrugated fiberboard, said wood-grain paper and said framing strips are all secured to each other by an adhesive material.

16. A casket structure, comprising:

a casket box of folded cellulosic material for holding the remains of a deceased person, said box having sides and top edges;

top and bottom framing strips for the exterior of said box;

a cladding thinner than the walls of said casket box secured and conforming to the exterior of said casket box;

said cladding comprising a first layer of pliable, foldable, creasible cellulosic material and a second thin, pliable, creasible layer of decorative material bonded to said first layer;

said cladding extending around and adhering to said framing strips to hold them in the desired position for their application to the exterior of said box; and means bonding said cladding and said framing strips to the exterior of said casket box in conforming surface relation thereto.

17. The casket structure of claim 16, wherein a double run of said cladding extends between said top and said bottom framing strips, said runs being bonded to each other.

18. The method of forming a casket structure, comprising:

forming an inner box for receiving human remains;

laminating a thin sheet of flexible decorative material to a layer of a readily-foldable, self-supporting cellulosic material to form a laminate blank thinner than the walls of said inner box;

scoring said blank along score lines, and removing portions thereof to provide cut-outs;

folding and positioning said laminate blank so that it lies against and conforms to the exterior of an outer sidewall of said inner box, and adhering it in that position;

said score lines being placed in said blank to facilitate bending of said laminate, thereby to enable it to conform to the exterior shape of said sidewall, and said cut-outs being placed and configured to enable said laminate to be folded about a corner of said inner box, while preserving a smooth continuous appearance for the exterior of said casket.

19. The method of claim 18, comprising enclosing top and bottom framing strips in said folded-up laminate blank prior to securing said laminate to said inner box, thereby to mount said framing strips on said box with said laminate extending over them.

20. The method of forming a casket structure comprising:

forming an inner box for receiving human remains;

laminating a thin sheet of flexible, foldable decorative material to a thicker layer of a foldable material to form a laminate blank, the blank being thinner than the walls of the inner box;

scoring said blank along score lines and removing portions thereof to provide cut-outs;

placing said laminate blank so it lies against, and conforms to the exterior of, a pair of adjacent walls of said inner box with its decorative material facing outward, and securing it in that position;

said score lines being placed in said blank so as to facilitate bending of said laminate to enable it to conform to the exterior shape of said adjacent sidewalls and said cut-outs being placed and configured to enable said laminate to be folded about said adjacent walls of said inner box, while preserving a smooth, continuous, substantially seamless appearance of the exterior of said casket.

21. A casket structure comprising a casket box and a flexible but self-supporting laminate comprising a first layer of cellulosic material adhered to a second layer of decorative material of less thickness then said first layer, said laminate being bent so as to conform to the external configuration of the box; wherein a portion of said laminate is folded back on itself to form two flat parallel runs thereof, and means adhering said two runs to each other; wherein said portion of said first layer extends beyond said second layer and consists of said first layer only; and wherein said structure comprises at least one framing strip, said laminate extending over and against, and being adhered to, the outer face and at least one side edge of said framing strip.

22. The structure of claim 21, wherein said portion of said second layer extends over and is adhered to the rear side of said framing strip.

23. The structure of claim 22, wherein said laminate extends beyond the top side of said framing strip and is scored to facilitate its folding over the top of said framing strip and downward into said casket when mounted adjacent the top of a wall of said casket.

24. The structure of claim 23, comprising a second framing strip having a front side, a rear side, a top side and a bottom side, and spaced from said first framing strip, said laminate extending over and adhered to the front, rear and side surfaces of said second framing strip.

25. The method of providing a cladding for the exterior of a casket, comprising:

providing a blank comprising a first layer of a pliable, foldable cellulosic material adhered to a second layer of decorative material of lesser thickness than said first layer, to form a laminate, said first layer having a portion at its bottom edge extending beyond the periphery of said second layer;

scoring said laminate along parallel score lines to provide fold lines about which said laminate is foldable;

adhering an upper and a lower framing strip to said laminate at spaced apart positions, located so that when said laminate is folded at said score lines it is positioned along and conformingly over the front of each of said framing strips;

folding said bottom-edge portion of said blank upward and conformingly against the rear side of said lower framing strip, over the confronting side of said first layer, and over the rear side of said upper framing strip, and adhering it in this position; and lifting the resulting assembly as a unit, placing it against the exterior of said casket, and adhering it thereto.

26. The method of providing a decorative covering for the exterior of a casket box predetermined wall thickness, for receiving human remains, comprising:

providing a pre-formed, self-supporting cladding which fits the shape of the exterior of said box, and then adhering said cladding to said casket box exterior so as to conform thereto;

said pre-forming of said cladding comprising forming a laminate having a first layer of pliable, scorable, foldable cellulosic material adhered to a second decorative layer of pliable, scorable, foldable material thinner than said first layer, and scoring and folding said laminate to provide said shape therefor, said laminate being thinner than said casket box wall thickness.

27. The method of providing a casket comprising an inner box for receiving human remains, which comprises:

providing a flat blank comprising a first layer of pliable, foldable, self-supporting cellulosic material suitable for constituting the inner box of said casket, a second layer of pliable, foldable cellulosic material thinner than said first layer and adhered to one side of said first layer, and a third layer of a thin, sheet-like, pliable, foldable and decorative material adhered to the side of said second layer opposite from said first layer;

scoring said blank to provide score lines therein, and later folding it along said score lines to form said blank into the shape of said casket inner box, with said second and third layers on the outside thereof.

* * * * *

UNITED STATES PATENT AND TRADEMARK OFFICE

CERTIFICATE OF CORRECTION

PATENT NO. : 5,454,141

DATED : October 3, 1995

INVENTOR(S) : Leland D. Ozbun and John d. Soroka

It is certified that error appears in the above-identified patent and that said Letters Patent is hereby corrected as shown below:

Column 2, line 7, after "herewith", insert --now abandoned--.

Column 11, line 47, Claim 24, change "23" to --22--.

Signed and Sealed this

Twenty-ninth Day of October 1996

*Attest:*

*Attesting Officer*

BRUCE LEHMAN

*Commissioner of Patents and Trademarks*